US006315292B1

(12) United States Patent
Howlett et al.

(10) Patent No.: US 6,315,292 B1
(45) Date of Patent: Nov. 13, 2001

(54) EDUCATIONAL BOARD GAME FOR LEARNING TO DRIVE SAFELY

(76) Inventors: Anthony R. Howlett, Flat 3 Byron Court, 44 Lanhill Road, London (GB), W9 2BS; Raphael E. Louis, 98 Oliphant Street, North Kensington, London (GB), W10 4EB ( * ) Notice: Subject to any disclaimer, the term of this patent is extended or adjusted under 35 U.S.C. 154(b) by 0 days.

(21) Appl. No.: 09/415,011

(22) Filed: Oct. 8, 1999

(51) Int. Cl.[7] ..... A63F 3/00
(52) U.S. Cl. ..... 273/236; 273/430; 273/243
(58) Field of Search ..... 273/236, 242, 273/243, 276, 287, 282.1, 430, 246, 244

(56) References Cited

U.S. PATENT DOCUMENTS

D. 273,402 4/1984 Adkins .
2,239,779 4/1941 Clark et al. .
2,620,192 * 12/1952 Housley .
3,817,531 * 6/1974 King .
4,090,717 * 5/1978 Rossetti .
4,341,388 7/1982 Carter .
4,907,808 * 3/1990 Turner .
5,002,283 3/1991 Langham .
5,092,606 * 3/1992 Miller .
5,259,623 11/1993 Kanelos, Sr. .
5,356,151 * 10/1994 Abecassis .
5,676,369 * 10/1997 DeWeese .
5,683,087 * 11/1997 Henshaw .
5,749,579 * 5/1998 Piacentino .
5,749,580 5/1998 Lopez .

* cited by examiner

*Primary Examiner*—Jeanette Chapman
*Assistant Examiner*—Vishu K. Mendiratta

(57) ABSTRACT

A educational board game for learning to drive safely for teaching proper safe driving rules and educating a person to the requirements of a driving test. The educational board game for learning to drive safely includes a game board having a playing surface, the playing surface having a start space and a plurality of playing spaces, a plurality of playing pieces, a plurality of vehicle models, each vehicle model having a plurality of vehicle parts couplable to form the vehicle model, a plurality of game cards, and a pair of dice.

1 Claim, 2 Drawing Sheets

EDUCATIONAL BOARD GAME FOR LEARNING TO DRIVE SAFELY

BACKGROUND OF THE INVENTION

1. Field of the Invention

The present invention relates to educational games and more particularly pertains to a new educational board game for learning to drive safely for teaching proper safe driving rules and educating a person to the requirements of a driving test.

2. Description of the Prior Art

The use of educational games is known in the prior art. More specifically, educational games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,002,283; U.S. Pat. No. 5,749,580; U.S. Pat. No. 5,259,623; U.S. Pat. No. 2,239,779; U.S. Pat. No. 4,341,388; and U.S. Pat. No. Des. 273,402.

While these devices fulfill their respective, particular objectives and requirements, the aforementioned patents do not disclose a new educational board game for learning to drive safely. The inventive device includes a game board having a playing surface, the playing surface having a start space and a plurality of playing spaces, a plurality of playing pieces, a plurality of vehicle models, each vehicle model having a plurality of vehicle parts couplable to form the vehicle model, a plurality of game cards, and a pair of dice.

In these respects, the educational board game for learning to drive safely according to the present invention substantially departs from the conventional concepts and designs of the prior art, and in so doing provides an apparatus primarily developed for the purpose of teaching proper safe driving rules and educating a person to the requirements of a driving test.

SUMMARY OF THE INVENTION

In view of the foregoing disadvantages inherent in the known types of educational games now present in the prior art, the present invention provides a new educational board game for learning to drive safely construction wherein the same can be utilized for teaching proper safe driving rules and educating a person to the requirements of a driving test.

The general purpose of the present invention, which will be described subsequently in greater detail, is to provide a new educational board game for learning to drive safely apparatus and method which has many of the advantages of the educational games mentioned heretofore and many novel features that result in a new educational board game for learning to drive safely which is not anticipated, rendered obvious, suggested, or even implied by any of the prior art educational games, either alone or in any combination thereof.

To attain this, the present invention generally comprises a game board having a playing surface, the playing surface having a start space and a plurality of playing spaces, a plurality of playing pieces, a plurality of vehicle models, each vehicle model having a plurality of vehicle parts couplable to form the vehicle model, a plurality of game cards, and a pair of dice.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new educational board game for learning to drive safely apparatus and method which has many of the advantages of the educational games mentioned heretofore and many novel features that result in a new educational board game for learning to drive safely which is not anticipated, rendered obvious, suggested, or even implied by any of the prior art educational games, either alone or in any combination thereof.

It is another object of the present invention to provide a new educational board game for learning to drive safely that may be easily and efficiently manufactured and marketed.

It is a further object of the present invention to provide a new educational board game for learning to drive safely that is of a durable and reliable construction.

An even further object of the present invention is to provide a new educational board game for learning to drive safely which is susceptible of a low cost of manufacture with regard to both materials and labor, and which accordingly is then susceptible of low prices of sale to the consuming public, thereby making such educational board game for learning to drive safely economically available to the buying public.

Still yet another object of the present invention is to provide a new educational board game for learning to drive safely which provides in the apparatuses and methods of the prior art some of the advantages thereof, while simultaneously overcoming some of the disadvantages normally associated therewith.

Still another object of the present invention is to provide a new educational board game for learning to drive safely for teaching proper safe driving rules and educating a person to the requirements of a driving test.

Yet another object of the present invention is to provide a new educational board game for learning to drive safely which includes a game board having a playing surface, the playing surface having a start space and a plurality of playing spaces, a plurality of playing pieces, a plurality of vehicle models, each vehicle model having a plurality of vehicle parts couplable to form the vehicle model, a plurality of game cards, and a pair of dice.

Still yet another object of the present invention is to provide a new educational board game for learning to drive safely that requires a player to answer questions relating to highway rules and regulations in order to advance in the game.

Even still another object of the present invention is to provide a new educational board game for learning to drive safely that provides consequences related to driving activities in order to teach potential vehicle drivers the responsibilities and the potential consequences associated with driving privileges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
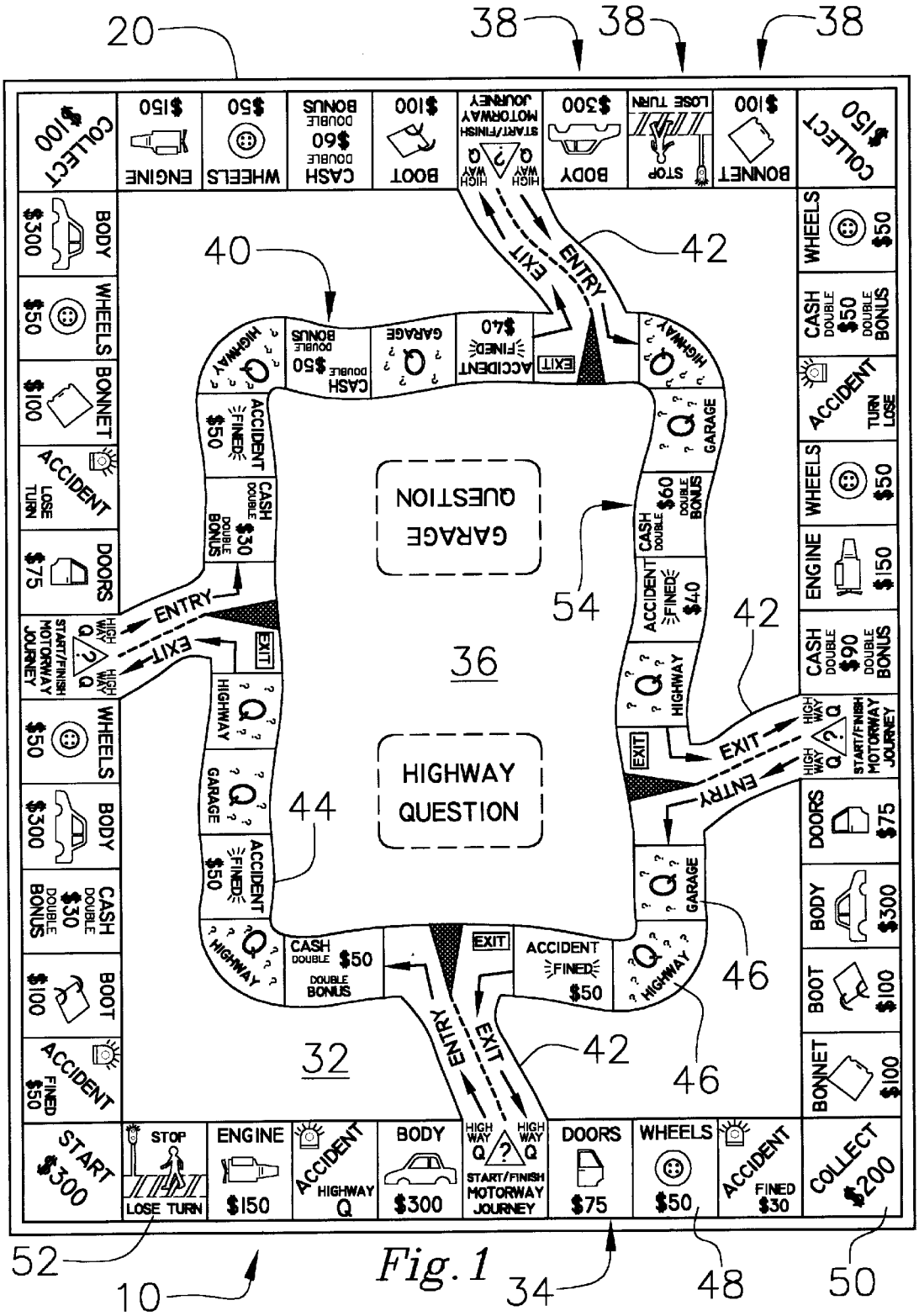
FIG. 1 is a top view of a game board of a new educational board game for learning to drive safely according to the present invention.
Figure 2:
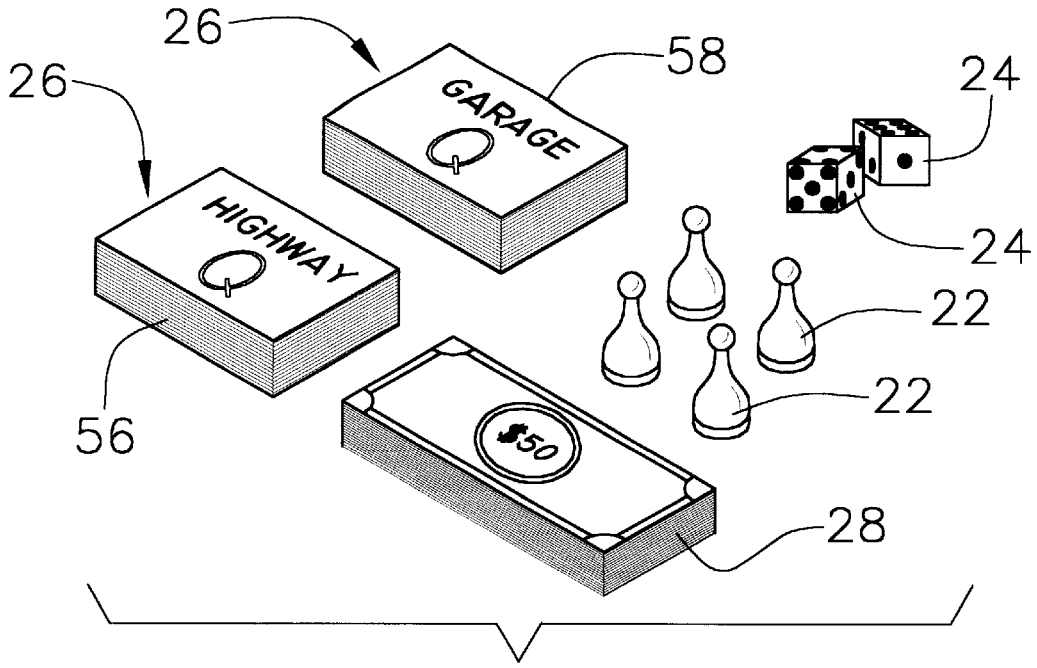
FIG. 2 is a perspective view of the playing pieces, question cards, dice and play money for the present invention.
Figure 3:
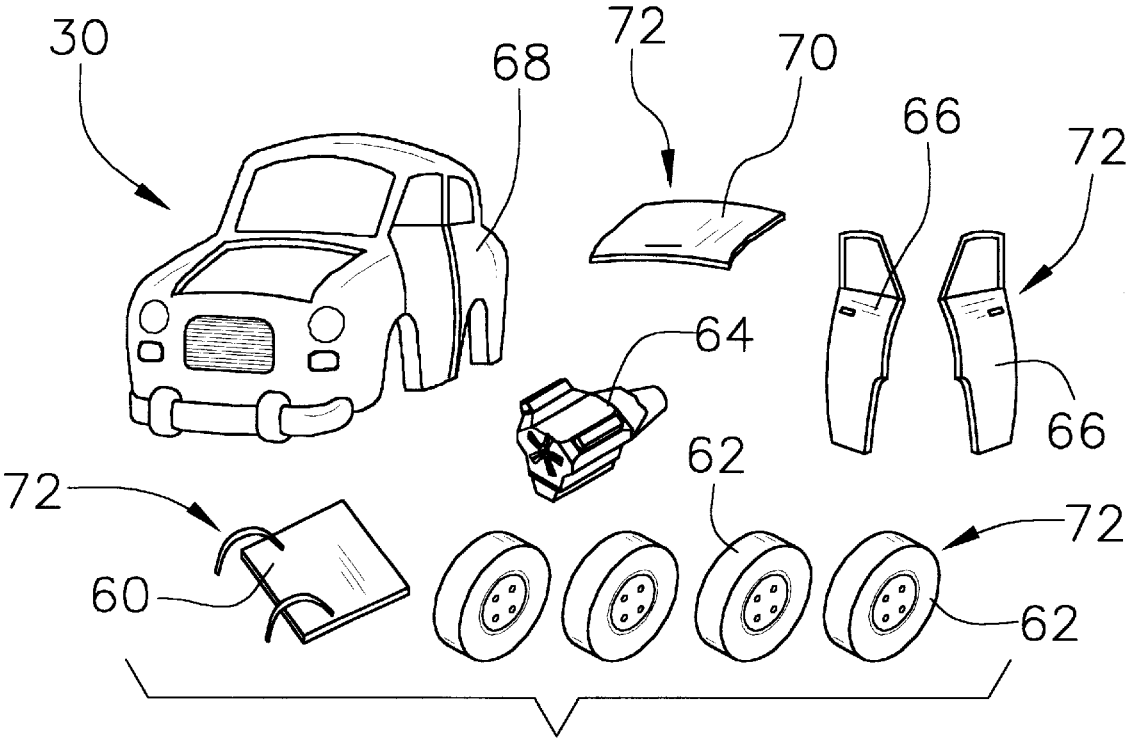
FIG. 3 is a perspective view of the vehicle portions of the present invention.

With reference now to the drawings, and in particular to FIGS. 1 through 3 thereof, a new educational board game for learning to drive safely embodying the principles and concepts of the present invention and generally designated by the reference numeral 10 will be described.

As best illustrated in FIGS. 1 through 3, the educational board game for learning to drive safely 10 generally comprises a game board 20, playing pieces 22, dice 24, playing cards 26, play money 28 and a plurality of vehicle models 30. The game board has a playing surface 32. The playing surface has an outer path 34, an interior portion 36 and a plurality of playing spaces 38. The playing spaces are divided into motorway spaces 40, motorway enter/exit spaces 42, accident spaces 44, card draw spaces 46, part acquisition spaces 48, corner spaces 50, and lose turn spaces 52. The lose turn spaces may be called zebra spaces due to the resemblance of a cross-walk to a striped zebra and the association of the lost turn due to waiting for pedestrians to cross the street. One of the corner spaces further serves as a start space from which all the players begin movement of their respective game piece.

The motorway spaces have a rectangular arrangement to define a inner path track 54 positioned in the interior portion of the game board. The motorway enter/exit spaces extend between the outer path of the game board and the inner path to link the motorway spaces to the other playing spaces on the board.

The plurality of playing cards are divided into a first group of question cards 56 called highway cards and a second group of question cards 58 called garage cards. Each of the first group of question cards has a vehicle law related question printed thereon and each of the second group of question cards has a driving code related question and a penalty amount indicator printed on the card. The vehicle law related questions may comprise questions about common rules of the road as well as rule of thumb type safe driving tips. The driving code related questions may comprise questions about codified laws relating to driving a vehicle.

The plurality of vehicle models are each made of separable vehicle portions 72, including a bonnet or car hood 60, tires 62, engine 64, doors 66, body 68, and a trunk or boot hood 70.

In an embodiment, the rules of the game are as follows:

1. Contents:

One game board and two dice

One box of highway code questions

One box of garage questions

Four pieces to move around board

Four scale model cars each consisting of:

| | | |
|---|---|---|
| ONE BODY | price | $ 300.00 |
| ONE BONNET | price | $ 100.00 |
| ONE BOOT | price | $ 100.00 |
| ONE ENGINE | price | $ 150.00 |
| TWO DOORS | price | $ 75.00/door |
| FOUR WHEELS | price | $ 50.00/wheel |

Money to purchase parts

2. Object:

For each player to totally rebuild his scale vehicle model by moving around the board building up their cash and landing on the parts acquisition spaces. The first player to totally rebuild his model car with all the correct parts is declared the winner. No player may start rebuilding until the main body part has been purchased.

3. Preparation for play:

Each player must choose their coloured game piece and begin their journey on the 'start' square. Each player starts off with $500.00.

| |
|---|
| 4 × $100.00 |
| 1 × $ 50.00 |
| 1 × $ 20.00 |
| 2 × $ 10.00 |
| 2 × $ 5.00 |

4. Rules of the game:

a) Street wise is a game for 2–4 players b) Each player in turn must throw the dice c) The first to start being the one with the highest score d) The person with the lowest score must take on the job of mechanic. He will control the money and car parts.

e) Each person in turn must move their coloured piece around the board landing on a number of different spaces as described above, each containing different rules.

f) Players must aim to land on 'cash' and 'part acquisition' spaces that are needed.

g) Players may only purchase one part to his model car at any one time. This applies to the purchase of wheels and doors.

5. Rules of the Playing Spaces:

a) Start Space:

Each player begins their journey on this space. If during the game a player ends their movement of their coloured piece on the 'start' space, he or she, will receive a $300.00 cash bonus. This also applies to the other three corners of the board. If a player ends their movement of their coloured piece on cash corners they receive the money stated on that corner.

b) Part Acquisition Spaces:

If a player lands on a 'part' space they must first answer a Highway Code Question. If answered correctly and the player having enough money, they may purchase this part from the mechanic. Whether the player needs the part or not they must answer the question correctly to continue their journey. If answered incorrectly the player loses their turn and is unable to purchase the part from the mechanic. A player may sell any body part back to the mechanic at any time if in need of money for (cash for cost price).

c) Cash Bonus Spaces:

If a player lands on a cash bonus space they have one of two choices.

(1) To keep the money stated on the space and continue on their journey.

(2) Gamble and answer a Highway Code Question. If correct player doubles cash bonus and carries on. If answered incorrectly player loses all of cash bonus and loses their turn. As stated before there are four cash corners on the board. A player must ends their movement of their coloured piece on corner to receive the cash stated.

d) Zebra Spaces:

If a player lands on a 'zebra crossing space' then must allow people to cross, thus miss a turn.

e) Accident Spaces:

If a player lands on an accident space they must obey the instructions on this space. If the space contains a Q they must answer a question on the card. If correct the player continues the turn. If incorrect, the player loses their turn and if it is a garage question answered incorrectly, the player must also pay the amount stated on the garage card.

f) Start and End of Motorway Spaces:

If a player lands on this space they must answer a garage question. If answered correctly, the player avoids the motorway track, receives a cash bonus stated on the garage card and continues the turn. If answered incorrectly, the player must move to the motorway track and proceed on the motorway track on the next turn.

6. Rules of Inner Path:

Once a player has moved on to the inner path they must be very careful because driving may become mayhem as the number of spaces having undesired results is greatly increased. There are lots of forfeits and no 'part' spaces on the motorway so players should aim to come off the motorway as soon as possible. Players can EXIT the motorway by landing exactly on a 'Motorway Exit Space' and answering a 'Highway Code Question'. If answered correctly, the player may exit to the outer path. If answered incorrectly, the player must stay on the inner path and miss a turn. They must then try to land on another 'exit space' on their next turn. Only being allowed to exit if a Highway Code Question is answered correctly.

7. Rules of Motorway Spaces:

a) Accident Motorway Spaces:

If a player lands on the 'accident space' while on the inner path they must immediately pay the penalty stated on the space. The player also loses their turn.

b) Inner Path question spaces:

If a player lands on a 'question space' while on the inner path, they must answer a question from the type of card stated on the space. If answered from the highway cards and the answer is correct, the player may throw again and continue the turn. If incorrect, the player simply loses their turn. If answered from the garage cards and the answer is correct, the player may continue the turn and also collect the amount stated on card. If answered incorrectly, as at all times with garage cards, the player loses their turn and must pay the amount stated on card.

c) Inner Path Cash Bonus Spaces:

Like all 'cash bonus spaces' the player has to choose one of the following.

1) Keep the cash and continue.

2) Gamble and double their money by answering a garage question correctly. Remember that on the motorway it is a garage question and if answered incorrectly the player must pay the amount on the card and lose a turn.

8. Money:

If a player is short of money they may sell any vehicle portion, at any time, back to the mechanic for the same price at which it was purchased. Players can only sell back vehicle portions if they have fines or penalties to pay.

9. Game over:

A players game is declared over when they have totally run out of cash and they have no body parts left to sell back to the mechanic.

10.Quick Game:

Each player may choose any three parts of the model car before game begins. They still keep their $500.00 to begin the game.

11. Winning the Game

The winner of the game is determined by the first player to fully assembly the vehicle model. Alternately, the last player to run out of money and vehicle portions to sell may be declared the winner by default.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for playing an educational board game for teaching players responsibilities and consequences associated with the privileges of driving a vehicle, the steps of the method comprising:

providing a board game comprising:

a game board having a playing surface, said playing surface having an outer path, an interior portion and a plurality of playing spaces, said playing spaces being divided into motorway spaces, motorway enter/exit spaces, accident spaces, card draw spaces, part acquisition spaces, corner spaces, and lose turn spaces;

said motorway spaces having a rectangular arrangement to define an inner path positioned in said interior portion of said game board, said motorway enter/exit spaces extending between said outer path of said game board and said inner path, said inner path being in a concentric relation to said outer path;

a plurality of playing cards, said playing cards being divided into a first group of question cards and a second group of question cards, each of said first group of question cards having a vehicle law related question, each of said second group of question cards having a driving code related question and a penalty amount indicator;

a plurality of vehicle models, each vehicle model having a plurality of separable vehicle portions;

a plurality of game pieces positionable on said playing surface;

a plurality of dice; and a plurality of bills of play money for purchasing said vehicle portions of said vehicle models and paying penalties;

providing a respective one of said game pieces for each player;

providing a quantity of said bills of play money to each player;

each of said players consecutively taking a turn, the steps of each turn comprising:

rolling a dice and moving the player's game piece on the game board to a playing space determined by the roll of the dice;

answering a driving code related question from one of said second group of playing cards when landing on one of said parts acquisition spaces, purchasing a corresponding vehicle portion for an associated price when a correct answer is given, ending said turn when an incorrect answer is given, the player having an option not to purchase said corresponding vehicle portion if said corresponding vehicle portion is not needed or if the player has insufficient amounts of said play money;

losing a turn when landing on one of said lose turn spaces;

collecting an associated amount of said play money when landing on one of said corner spaces, the player having an option to answer a question from said second group of question cards and collect twice the associated amount if correct or nothing if incorrect;

drawing a corresponding one of said playing cards when landing on one of said card draw spaces, following directions associated with landing on one of said accident spaces;

answering a question from said first group of question cards when moving along said outer path and landing on one of said motorway enter/exit spaces, entering said inner path when an incorrect answer is given, collecting an associated amount of play money and continuing the turn when a correct answer is given;

answering a question from said first group of question cards when moving along said inner path and landing on one of said motorway enter/exit spaces, exiting said inner path when a correct answer is given, paying an associated amount of play money, ending the turn, and continuing on the inner path on the next turn when an incorrect answer is given;

answering a question from an associated one of said first group or second groups of question cards when landing on one of said card draw spaces, continuing said turn when correctly answering a question from said second group of question cards, ending the turn when incorrectly answering a question from said second group of question cards, paying an associated amount of said play money and ending the turn when incorrectly answering a question from the first group of question cards, and receiving the associated amount of play money and continuing the turn when correctly answering the question from the first group of question cards;

winning the game upon collection of said vehicle portions to form a complete one of said vehicle models.

* * * * *